US007354110B1

(12) United States Patent
Raghubir

(10) Patent No.: US 7,354,110 B1
(45) Date of Patent: Apr. 8, 2008

(54) FOOT STOOL

(76) Inventor: Hermina Raghubir, 385 Red Rose Cir., Orlando, FL (US) 32835

( * ) Notice: Subject to any disclaimer, the term of this patent is extended or adjusted under 35 U.S.C. 154(b) by 0 days.

(21) Appl. No.: 11/477,112

(22) Filed: Jun. 28, 2006

(51) Int. Cl.
*A47C 16/00* (2006.01)
*A47C 31/00* (2006.01)
*A47C 7/62* (2006.01)
*A47B 39/00* (2006.01)

(52) U.S. Cl. ..... 297/423.45; 297/423.46; 297/183.1; 297/188.08; 297/135

(58) Field of Classification Search ..... 297/423.45, 297/423.46, 423.44, 423.41, 423.39, 183.1, 297/183.5, 188.08, 188.2, 135; 108/50.14, 108/25, 32, 28, 148.19, 50.11
See application file for complete search history.

(56) References Cited

U.S. PATENT DOCUMENTS 1,330,373 A * 2/1920 Hall ..... 297/135
1,515,760 A * 11/1924 Small ..... 297/244
2,267,158 A * 12/1941 Locke ..... 34/90
2,667,658 A * 2/1954 Cornick ..... 15/265
2,748,838 A * 6/1956 Scholl ..... 297/423.41
3,635,522 A * 1/1972 Kerwit ..... 297/153
3,653,715 A * 4/1972 Drabert et al. ..... 297/423.45
4,972,781 A * 11/1990 Montgomery et al. ..... 108/25
5,176,596 A * 1/1993 Ullman ..... 482/52
5,352,168 A * 10/1994 Wilkinson ..... 482/55
5,558,391 A * 9/1996 Chavous ..... 297/153
6,758,519 B2 * 7/2004 Harvey ..... 297/188.08
7,066,547 B1 * 6/2006 Russell et al. ..... 297/423.41

* cited by examiner

*Primary Examiner*—Milton Nelson, Jr.

(57) ABSTRACT

A foot stool is disclosed. An illustrative embodiment of the foot stool includes a plurality of legs, a foot support carried by the plurality of legs and an elongated heel slot provided in the foot support.

10 Claims, 4 Drawing Sheets

FOOT STOOL

FIELD

The present invention relates to stools. More particularly, the present invention relates to a foot stool which is particularly suitable for supporting feet of a user during a foot treatment procedure.

BACKGROUND

During various foot treatment procedures such as pedicures or the trimming of toenails, for example, it is typically necessary for a person to sit with his or her feet resting on a raised support. Lack of a suitable foot support renders it difficult to easily accomplish the foot treatment in a satisfactory fashion. Therefore, a stool is needed which is capable of supporting one or both feet of a user during a foot treatment procedure.

SUMMARY

The present invention is generally directed to a foot stool. An illustrative embodiment of the foot stool includes a plurality of legs, a foot support carried by the plurality of legs and an elongated heel slot provided in the foot support.

BRIEF DESCRIPTION OF THE DRAWINGS

The invention will now be described, by way of example, with reference to the accompanying drawings, in which.

DETAILED DESCRIPTION

Figure 1:
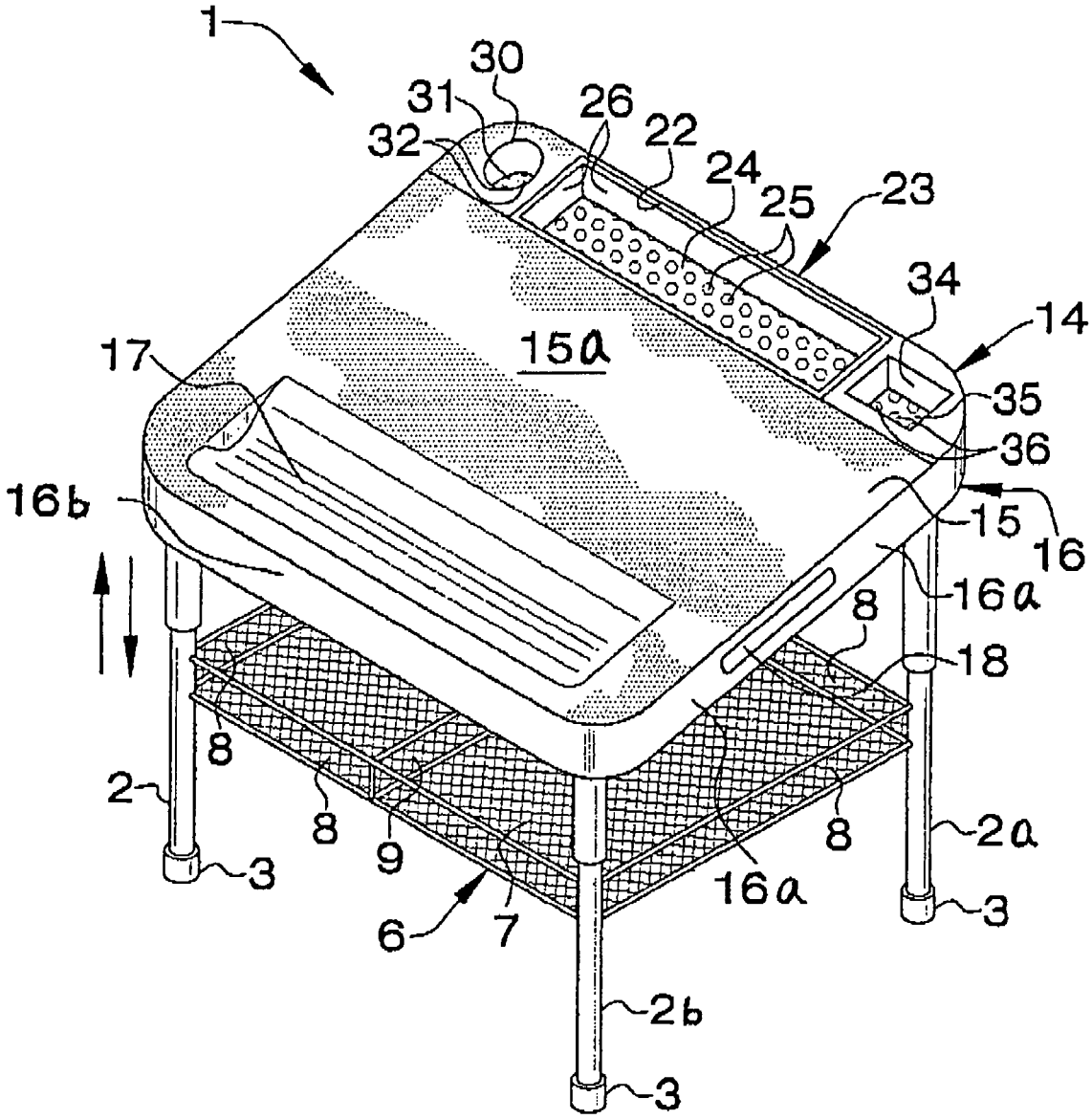
FIG. 1 is a perspective view of an illustrative embodiment of a foot stool.
Figure 2:
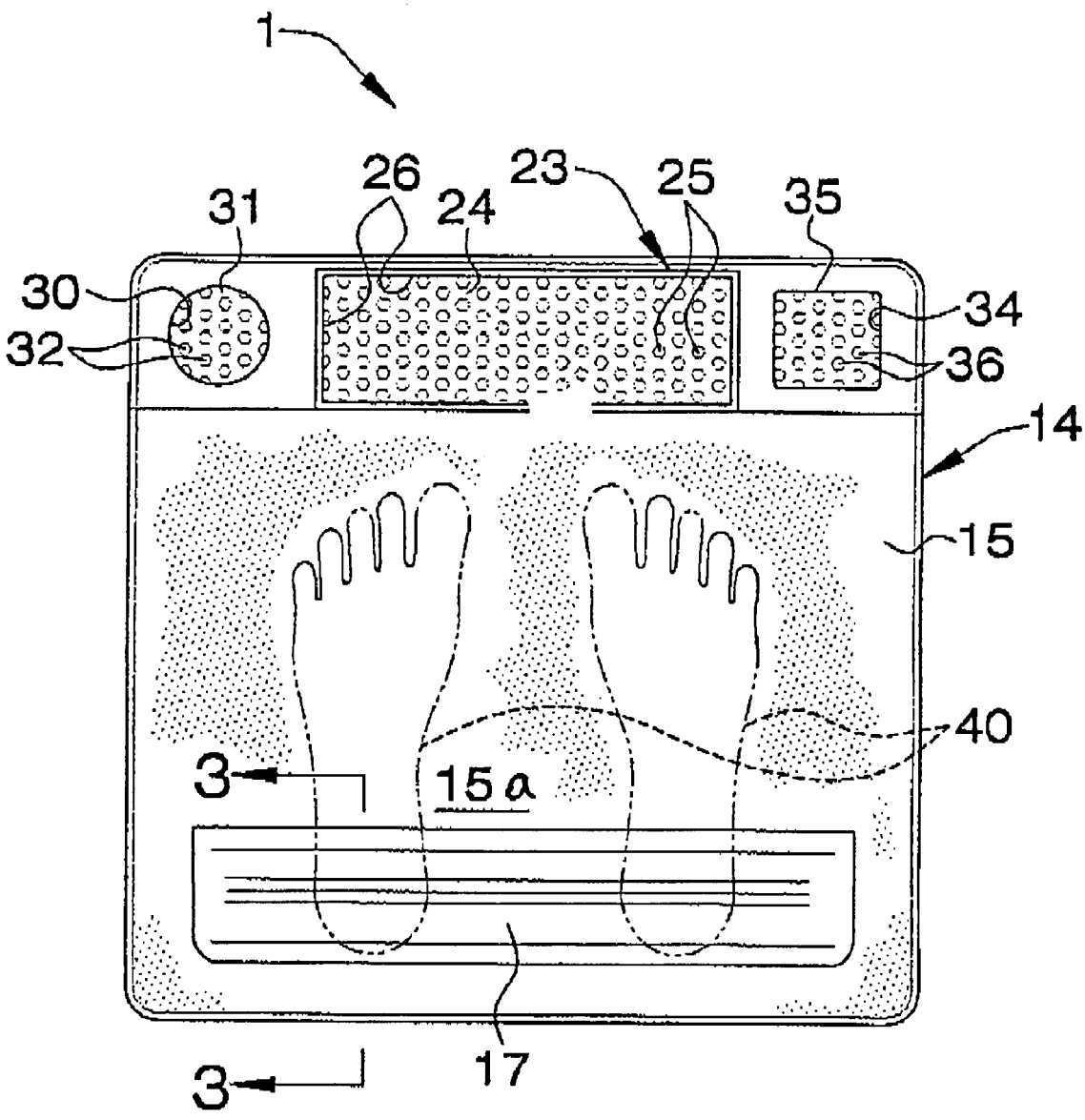
FIG. 2 is a top view of an illustrative embodiment of a foot stool, with a pair of feet (in phantom) positioned on the foot support of the foot stool during a foot treatment procedure.
Figure 3:
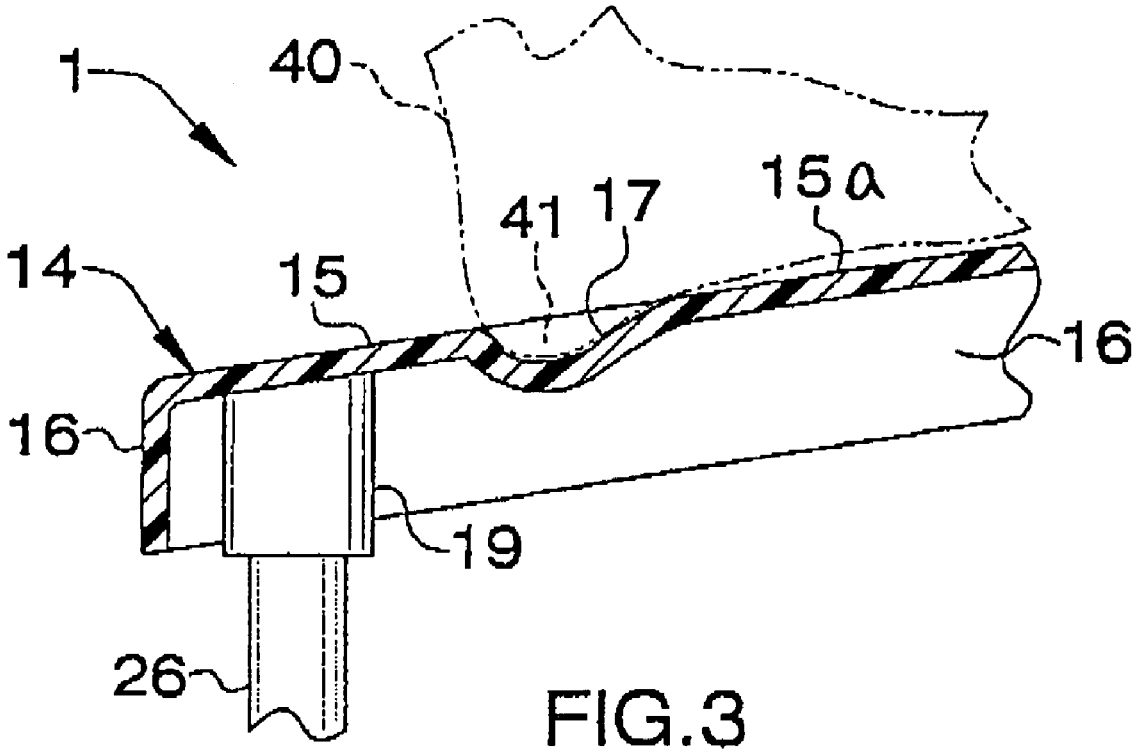
FIG. 3 is a sectional view, taken along section lines 3-3 in FIG. 2, illustrating a heel slot provided in the foot support.

Referring to the drawings, an illustrative embodiment of a foot stool is generally indicated by reference numeral 1. The foot stool 1 includes a foot support 14 which is supported by a pair of front legs 2*a* and a pair of rear legs 2*b*. The foot support 14 may have a generally rectangular shape, as shown in FIGS. 1 and 2, or may have any desired alternative shape. The foot support 14 may be plastic, metal or wood, in non-exclusive particular, and typically includes a panel 15 and a panel wall 16 extending downwardly from the panel 15 and defining the perimeter of the foot support 14. The panel wall 16 typically includes a pair of side wall portions 16*a*, a rear portion 16*b* extending between the side wall portions 16*a* along a rear edge of the panel 15 and a front wall portion (not shown) extending between the side portions 16*a* along a front edge of the panel 15. As shown in FIG. 3, multiple leg receptacles 19 may extend from the bottom surface of the panel 15 to receive the upper ends of the respective front legs 2*a* and rear legs 2*b*. As shown in FIG. 1, resilient foot pads 3, typically rubber or plastic, may be provided on the lower ends of the respective legs 2. In some embodiments, the front legs 2*a* are longer than the rear legs 2*b* such that the foot support 14 slopes upwardly from the rear wall portion 16*b* to the front wall portion (not shown) of the panel wall 16, as shown in FIGS. 1 and 3.

Figure 4:
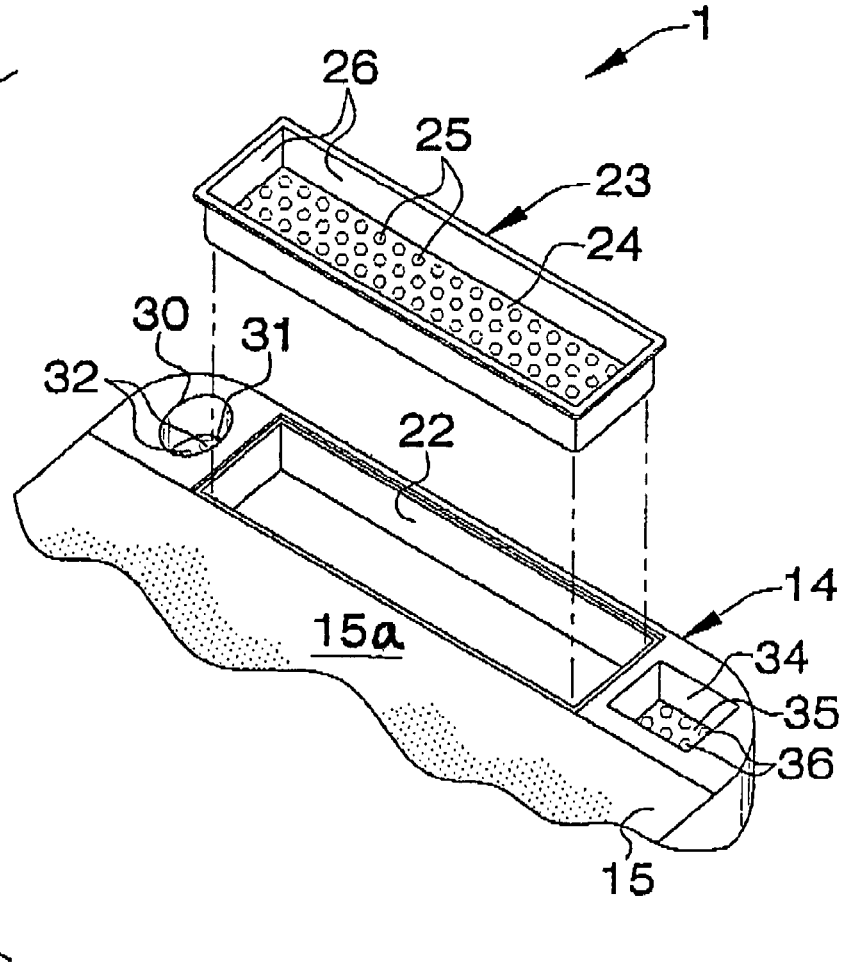
FIG. 4 is an exploded, perspective view, partially in section, illustrating detachable insertion of a tray in a tray slot provided in the foot support of the foot stool.

The panel 15 has a foot support surface 15*a*. An elongated heel slot 17 may extend into the foot support surface 15*a*, typically adjacent to the rear wall portion 16*b* of the panel wall 16. A handle slot 18 may be provided in each side wall portion 16*a* of the panel wall 16 to facilitate carrying of the foot stool 1. Various compartments and trays may be provided on the foot support 14, typically adjacent to the front edge of the panel 15. For example, a tray 23 may be provided on the foot support 14. As shown in FIG. 4, the tray 23 may be detachably seated in a tray slot 22 provided in the panel 15 of the foot support 14. The tray 23 may have a generally elongated, rectangular shape and typically includes a tray bottom 24. Tray sides 26 extend from the tray bottom 24. Multiple tray openings 25 may extend through the tray bottom 24 in a selected pattern to facilitate drainage of water from the tray 23 during use of the foot stool 1 in a shower (not shown), as will be hereinafter described. A tool compartment 30, having a tool compartment bottom 31, typically provided with multiple compartment openings 32, may further be provided in the foot support surface 15*a* of panel 15 on the foot support 14. A second tool compartment 34, having a tool compartment bottom 35 typically provided with multiple compartment openings 36, may additionally be provided in the foot support surface 15*a* of the panel 15. The tool compartments 30, 34 may be provided on opposite sides of the tray 23.

As shown in FIG. 1, a basket 6, such as a mesh basket, of selected design may be provided on the foot stool 1. For example, the basket 6 may be supported by the front legs 2*a* and rear legs 2*b*, beneath the foot support 14. The basket 6 may include, for example, basket sides 8 which extend between the legs 2. A basket bottom 7 is provided on the basket sides 8. A basket partition 9 may extend between the basket sides 8 to compartmentalize the basket 6.

In typical use of the foot stool 1, a user sits on a chair (not shown) or other support and places his or her feet 40 on the foot support surface 15*a* of the panel 15, as shown in phantom in FIGS. 2 and 3, to carry out a foot treatment procedure, such as a pedicure or toenail trimming, for example, on the feet 40. During a pedicure, the user may place the heels 41 of her feet 40 in the heel slot 17 to stabilize her feet 40 on the foot support surface 15*a*. Various tools (not shown), as well as gels, creams, ointments (not shown) and the like used in the foot treatment procedure, may be placed in the tray 23 and/or the tool compartments 30, 34 for convenience. Accordingly, during the foot treatment procedure, the user can easily treat his or her feet 40 as they rest on the foot support surface 15*a*. The foot stool 1 can be used in the shower (not shown), as desired, since water from the shower falls through the tray openings 25 of the tray 23, the compartment openings 32 of the tool compartment 30 and the compartment openings 36 of the tool compartment 34, and therefore, does not accumulate in the tray 23, the tool compartment 30 or the tool compartment 34.

While the preferred embodiments of the invention have been described above, it will be recognized and understood that various modifications can be made in the invention and the appended claims are intended to cover all such modifications which may fall within the spirit and scope of the invention.

What is claimed is:

1. A foot stool, comprising:

a plurality of legs;

a foot support carried by said plurality of legs;

an elongated heel slot provided in said foot support;

a basket carried by said plurality of legs beneath said foot support;

said foot support comprises a panel and a panel wall extending from said panel, and wherein said heel slot is provided in said panel; and said panel wall comprises a pair of side wall portions and a rear wall portion extending between said pair of side wall portions.

2. The foot stool of claim 1 further comprising a handle slot provided in each of said pair of side wall portions.

3. The foot stool of claim 1 further comprising at least one tool compartment having a tool compartment bottom provided in said foot support.

4. The foot stool of claim 3 further comprising a plurality of compartment openings provided in said tool compartment bottom.

5. The foot stool of claim 1 further comprising a tray carried by said foot support.

6. The foot stool of claim 5 further comprising a tray slot provided in said foot support and wherein said tray is seated in said tray slot.

7. A foot stool, comprising:

a plurality of legs;

a foot support carried by said plurality of legs;

an elongated heel slot provided in said foot support;

a tray slot provided in said foot support;

a tray detachably seated in said tray slot, said tray having a tray bottom, tray sides extending from said tray bottom and a plurality of tray openings provided in said tray bottom; and a basket carried by said plurality of legs beneath said foot support.

8. The foot stool of claim 7 further comprising at least one tool compartment having a tool compartment bottom provided in said foot support.

9. The foot stool of claim 8 further comprising a plurality of compartment openings provided in said tool compartment bottom.

10. The foot stool of claim 7 wherein said basket comprises a plurality of basket sides carried by said plurality of legs, a basket bottom carried by said plurality of basket sides and a basket partition extending between said plurality of basket sides.

* * * * *